US005986624A

United States Patent [19]

Ando et al.

[11] Patent Number: 5,986,624

[45] **Date of Patent: *Nov. 16, 1999**

[54] DISPLAY APPARATUS

[75] Inventors: Tetsuo Ando, Kanagawa; Osamu Akimoto, Tokyo, both of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/622,691

[22] Filed: Mar. 26, 1996

[30] Foreign Application Priority Data

Mar. 30, 1995 [JP] Japan ..... P07-073699

[51] Int. Cl.[6] ..... G09G 3/22

[52] U.S. Cl. ..... 345/74; 345/75; 315/169.1

[58] Field of Search ..... 345/74, 75, 76, 345/211; 315/169.1, 169.3, 167, 350, 351, 352

[56] References Cited

U.S. PATENT DOCUMENTS 5,157,309 10/1992 Parker et al. ..... 345/76
5,191,217 3/1993 Kane et al. ..... 315/169.1
5,278,475 1/1994 Jaskie et al. ..... 315/169.1
5,300,862 4/1994 Parker et al. ..... 315/169.1
5,313,140 5/1994 Smith et al. ..... 315/169.1
5,552,617 9/1996 Pagones ..... 345/76
5,578,906 11/1996 Smith ..... 315/169.1
5,638,086 6/1997 Lee et al. ..... 345/74

*Primary Examiner*—Xiao Wu
*Attorney, Agent, or Firm*—Hill & Simpson

[57] ABSTRACT

A display apparatus employing a field emission type cathode includes an anode electrode, a first constant voltage source for applying a first constant voltage on the anode electrode, a phosphor element coated on the anode electrode, a gate electrode arranged for facing said phosphor element, a second constant voltage source for applying a second voltage lower than the first voltage to the gate electrode, a cathode electrode arranged for facing the phosphor element via the gate electrode, an insulator arranged for facing the phosphor element via the gate electrode, a current source electrically connected to the cathode electrode, and a cathode arranged on said cathode electrode for facing said phosphor element. The current value of the current source is controlled in proportion to a third voltage applied to the current source.

3 Claims, 7 Drawing Sheets

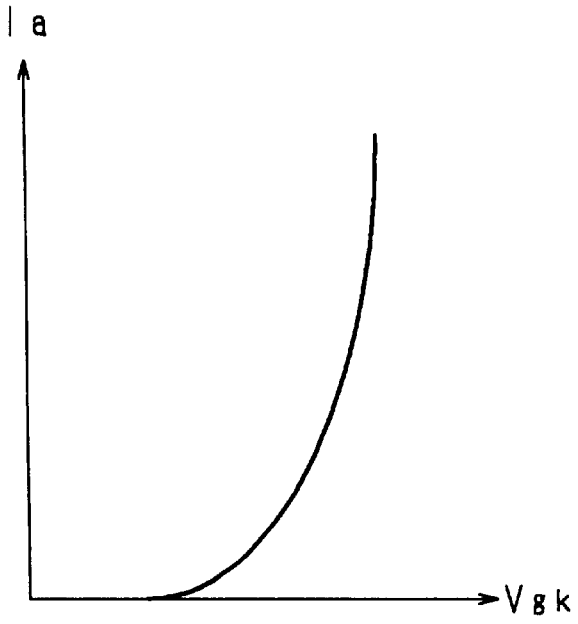
FIG.3
FIG.4A
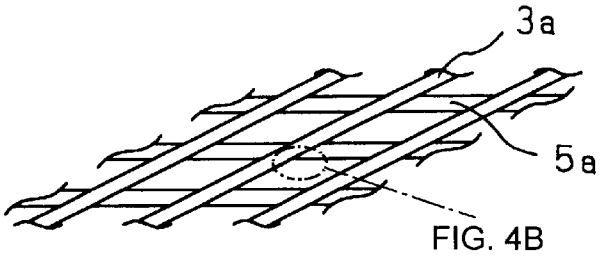
FIG.4B
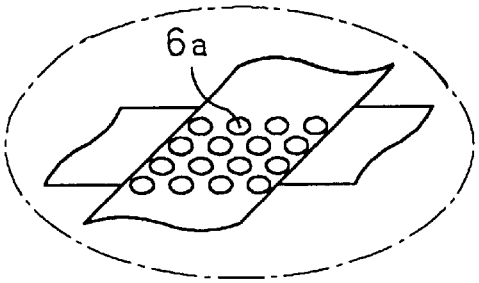

DISPLAY APPARATUS

BACKGROUND OF THE INVENTION

1. Field of the Invention

This invention relates to a display apparatus employing a field emission type cathode, and a method for driving the same.

2. Description of the Related Art

There has recently been developed a display employing, for example, a field emission type cathode as one of flat panel shaped display units employed for a display apparatus. As a display employing this field emission type cathode, there is known a field emission display (FED). The FED has many features, such as high picture quality and production efficiency, quick response speed, operability under extremely low temperature environments, high luminosity and high power efficiency. In addition, the FED can be produced by a simpler process than that for production of the so-called active matrix liquid crystal display. The production cost for the FED is expected to be lowered at least to as much as 40 to 60% of that of the active matrix type liquid crystal display.

Referring to FIGS. 1 and 2, the basic structure and the operating principle of the FED is explained.

FIG. 1 shows the basic structure of the FED. In this figure, a cathode emission section 50 includes a glass substrate 10, a cathode electrode 5, an insulator 4, a gate electrode 3 and a cathode 6. On a glass substrate 10 of the electron emission section 50 are layered the cathode electrode 5, insulator 4 and the gate electrode 3. On the glass substrate 10 is formed the cathode electrode 5 which is insulated from the gate electrode 3 by the insulator 4. The insulator 4 and the gate electrode 3 are formed with plural openings within which cathodes 6 for enhancing the intensity of the electrical field are arranged on the cathode electrode 5. The cathodes 6 and the cathode electrodes 5 are electrically connected with each other. The cathode electrodes 5 and the cathodes 6 make up a field emission type cathode. Facing the surface of the gate electrode 3 of the electron emission section 50 is arranged a light emitting section 51. That is, the light emitting section 51 is arranged in a direction along which electrons 7 are emitted from the cathode 6, as will be explained subsequently. The light emitting section 51 is comprised of a glass substrate 9 on which is layered an anode electrode 1 formed by a transparent material, such as indium tin oxide (ITO). A phosphor element 2 is coated on the surface of the anode electrode 1 facing the glass substrate 9. The surface of the phosphor element 2 faces the front surface of the gate electrode 3 of the electron emission section 50. The spacing between the electron emitting section 50 and the light emitting section 51 is maintained at vacuum. A plurality of the cathodes 6 are associated with a single pixel (phosphor element) (phosphor element 2), with the focal point of each cathode 6 being on the associated phosphor element 2. Thus, by applying an electrical voltage across the gate electrode 3 and the cathode electrode 5 of the electron emission section 50, electrons 7 are emitted from the electron emission section 50. In addition, by applying an electrical voltage across the anode electrode 1 of the light emission section 51 and the cathode electrode 5 of the electron emission section 50, the electrons 7 emitted are attracted towards the anode electrode 1 and collided against the phosphor element 2 of the light emitting section 51 for emitting light from the phosphor element 2. FIG. 1 shows an embodiment wherein the light emission section 51 is made up of three portions associated with three prime colors of red (R), green (G) and blue (B). The phosphor elements 2 emit the light in these three color R, G and B for realization of a color display.

Referring to FIG. 2, showing a portion of FIG. 1, the principle of driving of the field emission type cathode, employed in FED, is explained.

In FIG. 2, if a voltage Vk by a variable voltage source 53 and a voltage Vg by a variable voltage source 54 are applied to the cathode electrode 5 and the gate electrode 3, respectively, for applying a voltage difference represented by a voltage Vgk across the gate electrode 3 and the cathode electrode 5, the electrons 7 are emitted from the cathode 6 under an electrical field produced by such voltage application. If a voltage Va is applied by the variable voltage source 55 to the anode electrode 1, the electrons 7 are attracted towards the anode electrode 1 under a condition of $$Va > Vg \tag{1}$$

so that an anode current Ia flows in a direction indicated by arrow ar in FIG. 2. If the phosphor element 2 is pre-coated on the anode electrode 1, the phosphor element 2 emits light under the energy of the electrons 7. The amount of the electrons 7 is changed with the voltage Vgk so that the anode current Ia is also changed. On the other hand, the amount of light emission of the phosphor element 2, that is luminosity L of the emitted light, is related with the anode current Ia by $$L\ Ia \tag{2}$$

so that, by changing the voltage Vgk, the value of luminosity L of the emitted light can also be changed. Thus the conventional practice has been to achieve luminosity modulation by modulating the voltage Vgk in accordance with the signal to be displayed. That is, with the above-described method for driving the field emission type cathode, the voltage Vg of the variable voltage source 54 is changed in accordance with the signal to be displayed for changing the voltage Vgk (driving voltage) for realization of luminosity modulation.

Meanwhile, the field emission type cathode has characteristics as shown in FIG. 3, from which it may be seen that the relation between the driving voltage Vgk and the anode current Ia (field emission current) is not linear but exponential. That is, the difference voltage between the gate electrode and the cathode electrode, that is the driving voltage, is not changed in proportion to the anode current (field emission current) Ia.

However, since the relation between the luminosity L and the anode current Ia is as shown by the above formula (2), so that, for driving the conventional display employing the field emission cathode, it becomes necessary to employ a correction circuit for setting the relation of proportionality between the voltage Vg and the luminosity L, as in the case of the gamma correction (non-linear correction) of a cathode ray tube.

The FED is comprised of gate electrodes 3*a* of plural lines, corresponding to the gate electrodes 3, and a cathode electrode 5*a* corresponding to the cathode electrode 5, arrayed in a matrix configuration. At an intersection of the gate electrode 3*a* and the cathode electrode 5*a*, that is at a pixel, a plurality of field emission cathodes 6*a* are arrayed as shown in FIG. 4B in which is shown enlarged a portion of FIG. 4A. If characteristics of the field emission cathodes 6*a* exhibit variations as shown in FIG. 5, variations in luminosity due to variations in characteristics of the field emission cathodes 6*a* are produced. That is, inherent characteristics a of the field emission cathodes 6*a* undergo fluctuations as shown by characteristics b or c. The above-described compensation circuit is necessitated for compensating these variations in the characteristics of the field emission cathode 6*a*.

In addition, the above-described field emission cathode poses a problem in that the field emission current (anode current Ia) cannot be feed back to the driving voltage (voltage Vgk) while cathode instabilities cannot be absorbed. As for these inconveniences, that is that the field emission current cannot be fed back to the driving voltage and cathode instabilities cannot be absorbed, it has been reported that these inconveniences may be evaded by a high electrical resistance connected in series with the cathode electrode. In such case, however, problems are raised that the response speed of the cathode is retarded and additional production steps need to be included in the production process.

OBJECT AND SUMMARY OF THE INVENTION

It is therefore an object of the present invention to provide a display apparatus in which a compensation circuit is not needed and wherein there is no risk of retarded response speed of the cathode or of increased element production steps.

According to the present invention, there is provided a display apparatus including an anode electrode, a first constant voltage source for applying a first constant voltage on the anode electrode, a phosphor element coated on the anode electrode, a gate electrode arranged for facing said phosphor element; a second constant voltage source for applying a second voltage lower than the first voltage to the gate electrode, a cathode electrode arranged for facing the phosphor element via the gate electrode, an insulator arranged for facing the phosphor element via the gate electrode, a current source electrically connected to the cathode electrode, and a cathode arranged on the cathode electrode for facing the phosphor element. The current source has its current value controlled in proportion to a third voltage applied thereto.

The current source is an NPN transistor to the base terminal of which the third voltage corresponding to a signal to be displayed is applied. The collector terminal and the emitter terminal of the NPN transistor are connected to the cathode electrode and grounded via a resistor, respectively.

In accordance with the present invention, the current flowing through the cathode electrode is controlled responsive to a voltage modulated in accordance with the signal to be displayed. If the field emission current flowing between the anode electrode and the cathode electrode is proportionate to the luminosity of the emitted light, the voltage modulated by the signal to be displayed is also proportionate to the luminosity of the emitted light.

BRIEF DESCRIPTION OF THE DRAWINGS

FIG. 3 is a graph showing characteristics of the field emission cathode.

FIG. 4 illustrates a matrix configuration of the cathode and gate electrodes and the array of the field emission cathodes.

DESCRIPTION OF THE PREFERRED EMBODIMENTS

Figure 1:
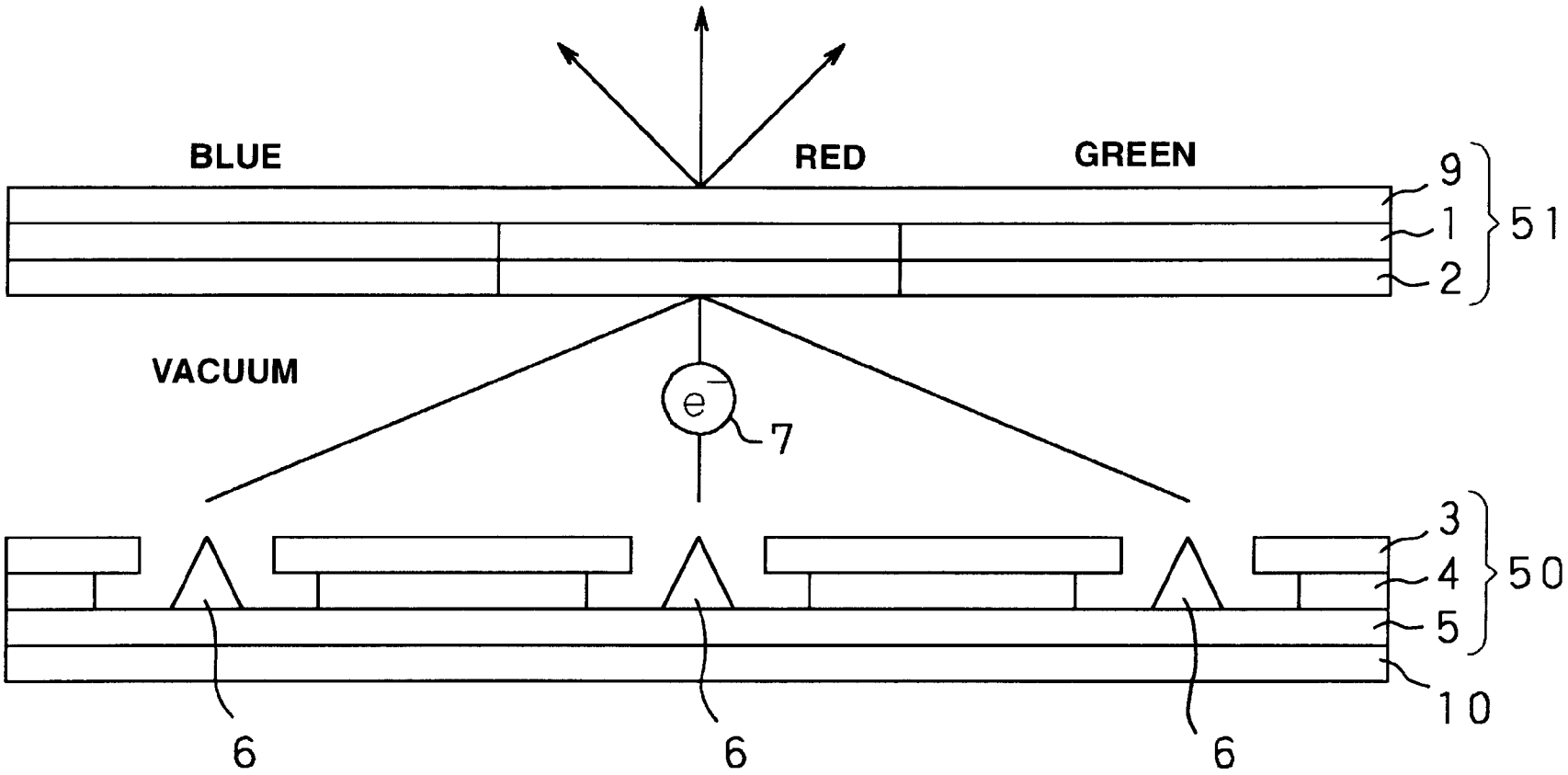
FIG. 1 illustrates the basic structure of an FED.

Referring to the drawings, preferred embodiments of the present invention will be explained in detail.

First, the driving method for the display apparatus of the present invention will be explained. Since the luminosity L of the emitted light is proportionate to the field emission current (anode current Ia), as discussed previously, the current intensity for realization of the required luminosity in the display apparatus driving method of the present invention is produced by controlling the voltage. That is, the configuration for realization of the driving method employs a current source by voltage control, and controls the cathode voltage, instead of controlling the gate voltage, as in the conventional practice.

Figure 6:
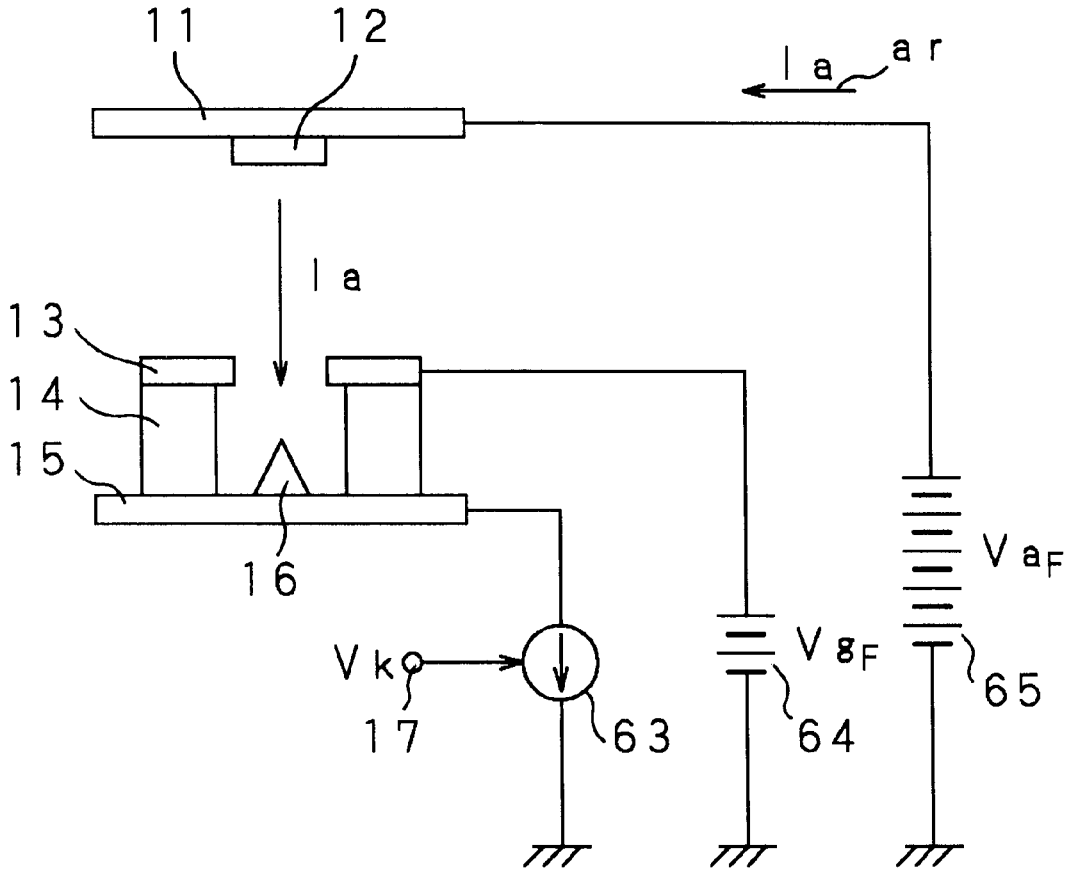
FIG. 6 illustrates an arrangement for illustrating the current control type driving method for the field emission cathode according to an embodiment of the present invention.

Referring to FIG. 6, the display apparatus and the driving method therefor will now be explained in detail.

FIG. 6 shows a cathode electrode 15, an insulator 14, a gate electrode 13, a cathode 16, as essential portions of an electron emission section of the field emission cathode employed in an FED, an anode electrode 11 and a phosphor element 12, as essential portions of a light emission section, a current source 63 electrically connected to the cathode electrode 16, a first voltage source 65 electrically connected to the anode electrode 11 and a second constant voltage source 64 electrically connected to the gate electrode 13.

To the anode electrode 11, formed of, for example, indium tin oxide (ITO), and to the gate electrode 13, a first voltage $V_{aF}$ from the first constant voltage source 65 and a second voltage $V_{gF}$ from the second constant voltage source 64 are impressed, respectively. The first voltage $V_{aF}$ and the second voltage $V_{gF}$ are related with each other by an equality $V_{aF>}V_{gF}$, as in the inequality (1) above. The current source 63 can be voltage-controlled, such that the current Ia is controlled in proportion to the third voltage Vk applied via a terminal 17.

Figure 7:
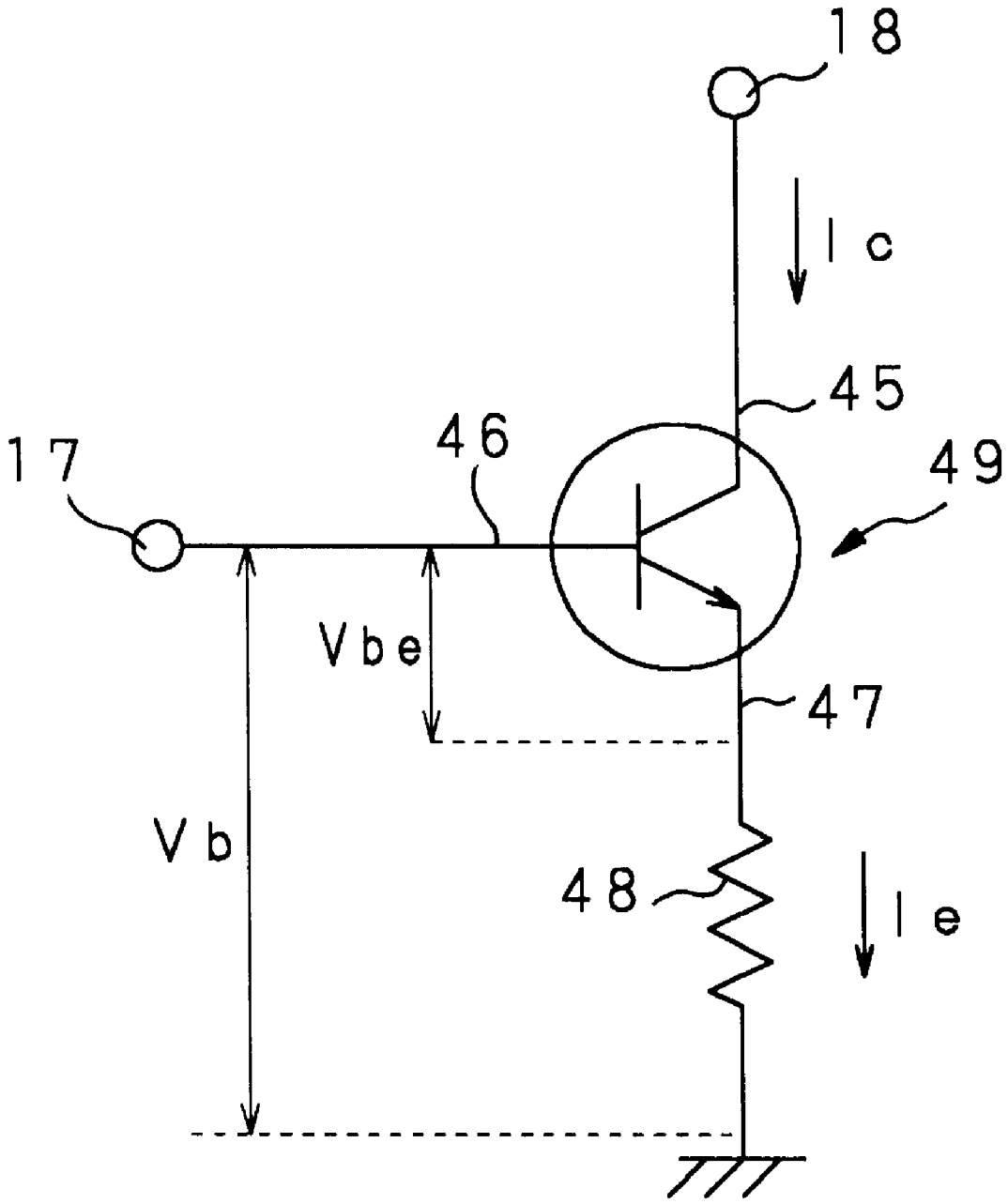
FIG. 7 is a circuit diagram showing an embodiment of a current source by a transistor.

FIG. 7 shows an illustrative construction of the current source 63 of FIG. 6.

Referring to FIG. 7, a transistor 49 is an NPN transistor having its base terminal 46 connected to a terminal 17 of FIG. 6, while having its collector terminal 45 connected via a terminal 18 to the cathode electrode 15 of FIG. 6 and having its emitter terminal 47 grounded via a resistor 48. The potential difference Vbe across the base terminal 46 and the emitter terminal 47 on turning on of the transistor 49 is approximately 0.6 V. Thus the potential difference across the base terminal 46 and the emitter terminal 47 on turning on of the transistor 49 on application of the voltage Vb to the base electrode 46 via terminal 17 is (Vb−Vbe). Thus the current Ie flowing through the resistor 48 is represented by $$Ie=(Vb-Vbe)/R \tag{3}$$

where R denotes a resistance value of the resistor 48. Since Vbe and R are constants, the relation.

$$Ie\ Vb \tag{4}$$

holds. On the other hand, the current Ic flowing through the collector electrode 45 and the current flowing through the resistor 48 are related to each other by $$Ie \approx Ic \quad (5)$$

from transistor characteristics. Therefore, if the collector terminal 45 of the transistor 49 of FIG. 7 is connected via terminal 18 to the cathode electrode 15 of FIG. 6, and the impressed voltage Vb supplied to the terminal 17 of FIG. 7 is set so as to be the impressed voltage Vk from the terminal 17 of FIG. 6, the current Ic flowing through the collector terminal 45 of FIG. 7, that is the field emission current Ia, is controlled by the impressed voltage Vk, that is Vb. Since the luminosity of the emitted light L is proportionate to the field emission current Ia, the impressed voltage Vb to the transistor 49, that is the impressed voltage Vk to the current source 63, is proportionate to the luminosity of the emitted light L.

In FIG. 7, the resistance value of the resistor 48 is set to not less than 1 kΩ and the current Ie is set so as to be not lower than 1 μA. The impressed voltage Vb is the pre-set resistance value of the resistor 48 multiplied by the current Ie less the potential difference Vbe, that is, $$Vb = R*Ie - Vbe \quad (7)$$

Figure 5:
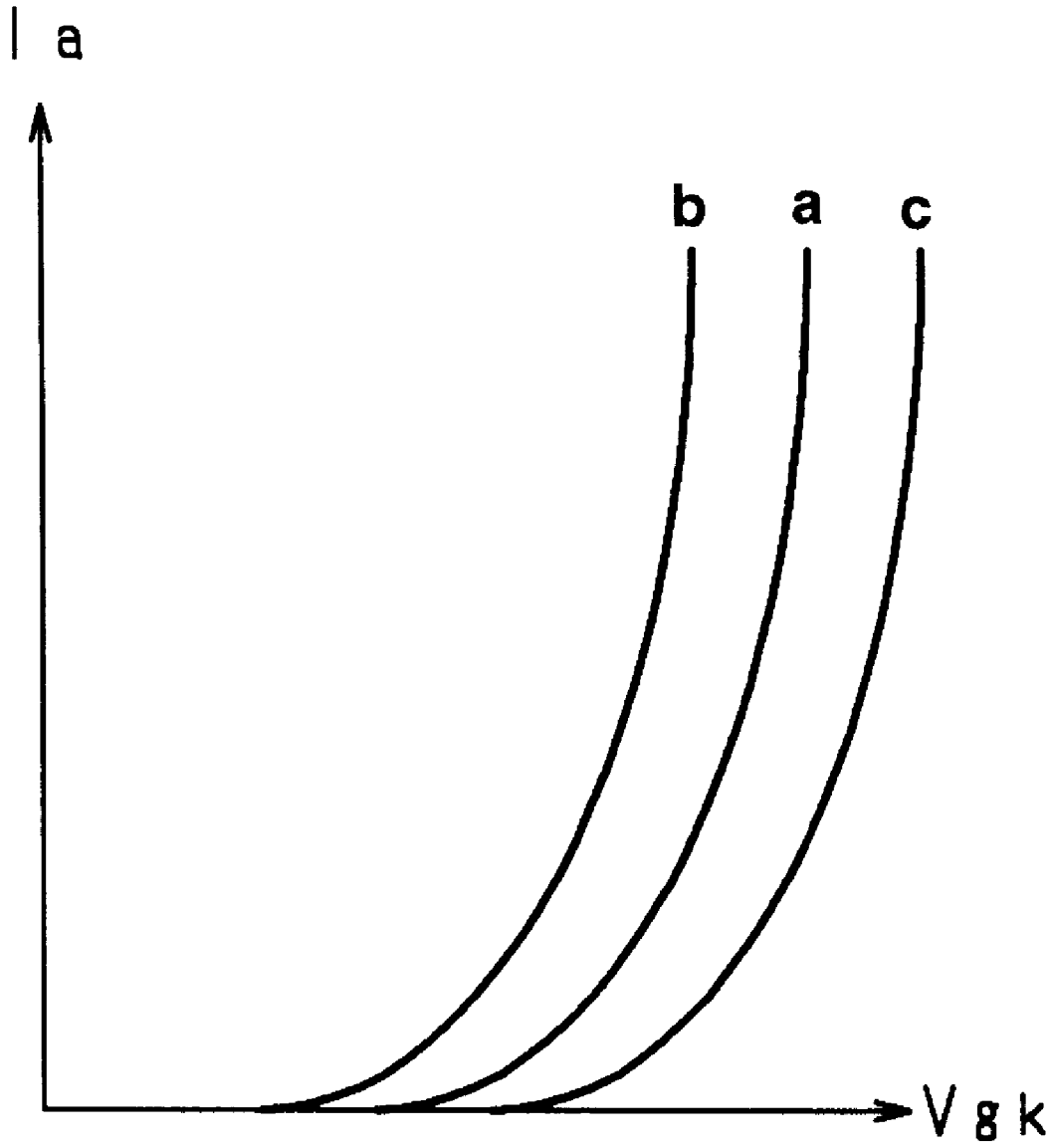
FIG. 5 shows characteristics of the field emission cathode.

It is seen from the foregoing that, if characteristics of the cathode 16 undergo variations, as shown in FIG. 5, or characteristics of the cathode 16 undergo variations due to changes with lapse of time, variations in luminosity, such as are produced with the above-described conventional driving method, are not produced, since the impressed voltage Vk to the current source 63 is set so that the current value which will produce the needed luminosity L of the emitted light will be set. In addition, since the current value of the current source 63 is managed in the present embodiment as described above, the present embodiment also has the function of limiting the current in case of occurrence of electrical discharge. Heretofore, the current limiting function in case of electrical discharge was realized by a resistor inserted between the cathode and the electrode. The conventional technique of realizing the current limiting function resides in adjusting the intensity of the electrical field by changes in the potential difference across the gate and the cathode brought about by resistance voltage drop caused by the current Ia for thereby controlling the current intensity. However, it is impossible with the conventional technique to cope with changes in cathode characteristics brought about by variations in cathode characteristics or changes in cathode characteristics brought about by changes with lapse of time. This inconvenience can be coped with in the present embodiment, since the current intensity Ia of the current source 63 is controlled by the voltage Vk.

If the arrangement shown in FIG. 6 is applied to the above-mentioned FED of FIG. 4, the collector terminal 45 of the transistor 49, that is the current source 63, is connected to each cathode electrode 9.

Figure 8:
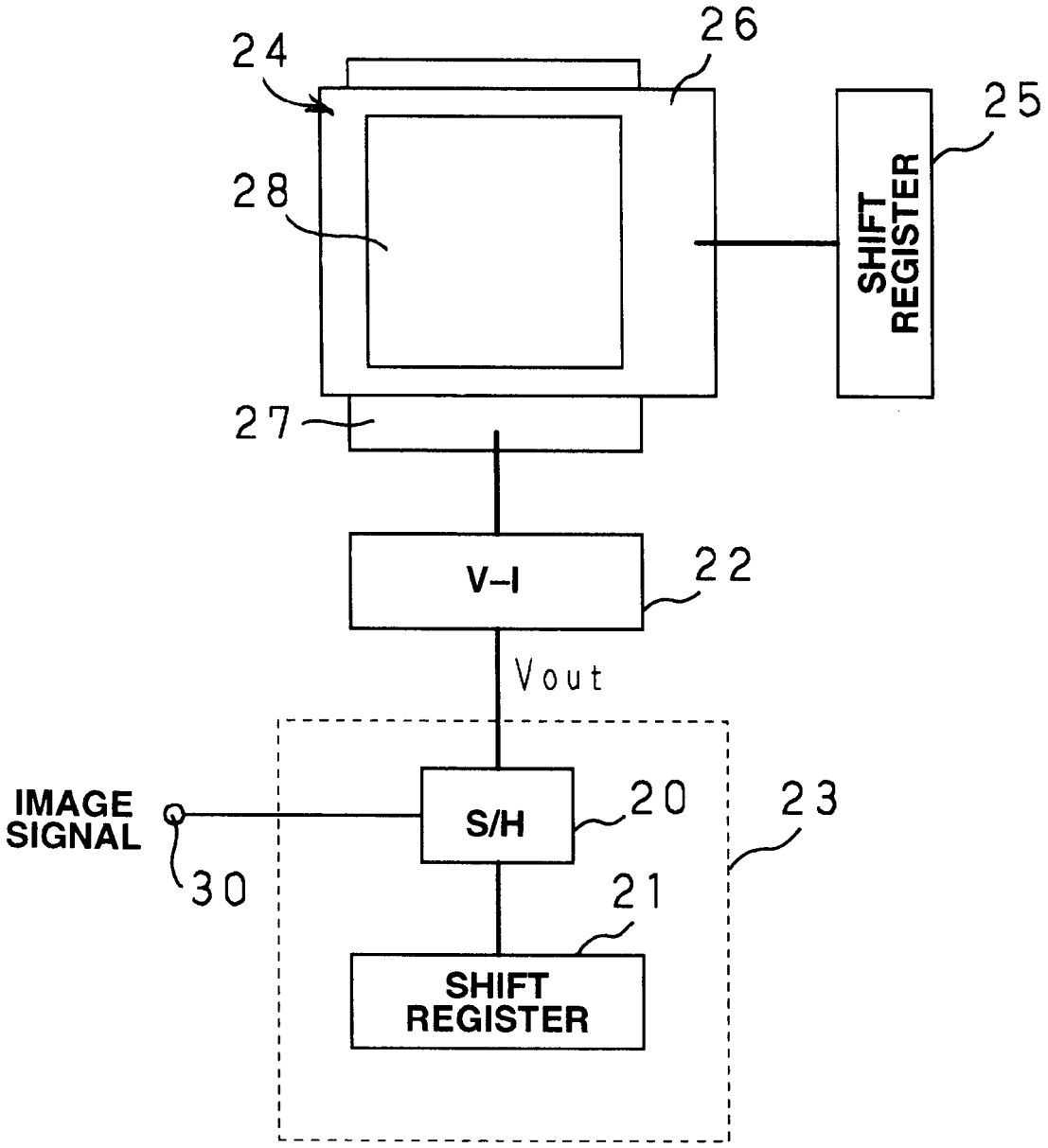
FIG. 8 illustrates an arrangement of an FED driving circuit according to an embodiment of the present invention.

Referring to FIG. 8, a system configuration in case of application of the display apparatus driving method to an FED 24, made up of gate electrodes 26 and cathode electrodes 27 in a matrix configuration as in FIG. 4, is explained.

The system configuration shown in FIG. 8 includes, as major components, the gate electrodes 26 and the cathode electrodes 27, arranged in a matrix configuration, a sample-and-hold circuit 20 for sample-holding image signals displayed on display responsive to sampling timing from a shift register 21 for generating modulated signals corresponding to the display signals, a voltage-to-current conversion circuit 22 adapted for converting an output voltage Vout from the sample-and-hold circuit 20, as a modulated signal corresponding to the image signal (display signal), into a current value, and having an output electrically connected to the cathode electrode 27, and a shift register 25 for outputting a timing for line-by-line selection of the gate electrodes 26.

The configuration of FIG. 8 is of a line-sequential system in which the gate electrodes 26 are selected line-by-line at a timing from the shift register 25 and in which the modulated signal output voltage Vout corresponding to the display signal is similarly outputted line-by-line at a driver 23 made up of the shift register 21 and the sample-and-hold circuit 20.

In the arrangement of FIG. 8, the gate electrodes 26 are selected line-by-line at the timing from the shift register 25. Simultaneously, the image signal supplied via a terminal 30 is supplied to the sample-and-hold circuit 20. This sample-and-hold circuit 20 sample-holds the image signal for deriving the signal intensity, that is a luminance signal (modulation signal for luminance modulation). The timing of sampling the image signal by the sample-and-hold circuit 20 is outputted line-by-line from the shift register 21. The luminance signal from the sample-and-hold circuit 20 is a voltage output Vout which is routed to the voltage-to-current conversion circuit 22. The voltage-to-current conversion circuit 22 converts the voltage Vout into a current output. An output of the voltage-to-current conversion circuit 22 is electrically connected to the cathode electrode 27 so that the cathode electrodes 27 are driven by the current signal from the voltage-to-current conversion circuit 22. That is, in the embodiment of FIG. 8, the voltage-to-current conversion circuit 22 corresponds to the current source 63 of FIG. 6.

With the arrangement, shown in FIG. 8, the gate electrodes 26 are selected line-by-line, while the cathode electrodes 27 are driven by the current output corresponding to the modulation signal from the driver 23, so that a display corresponding to the image signal is made on a display unit 28 made up of a matrix array of the gate electrodes 26 and the cathode electrodes 27.

Figure 2:
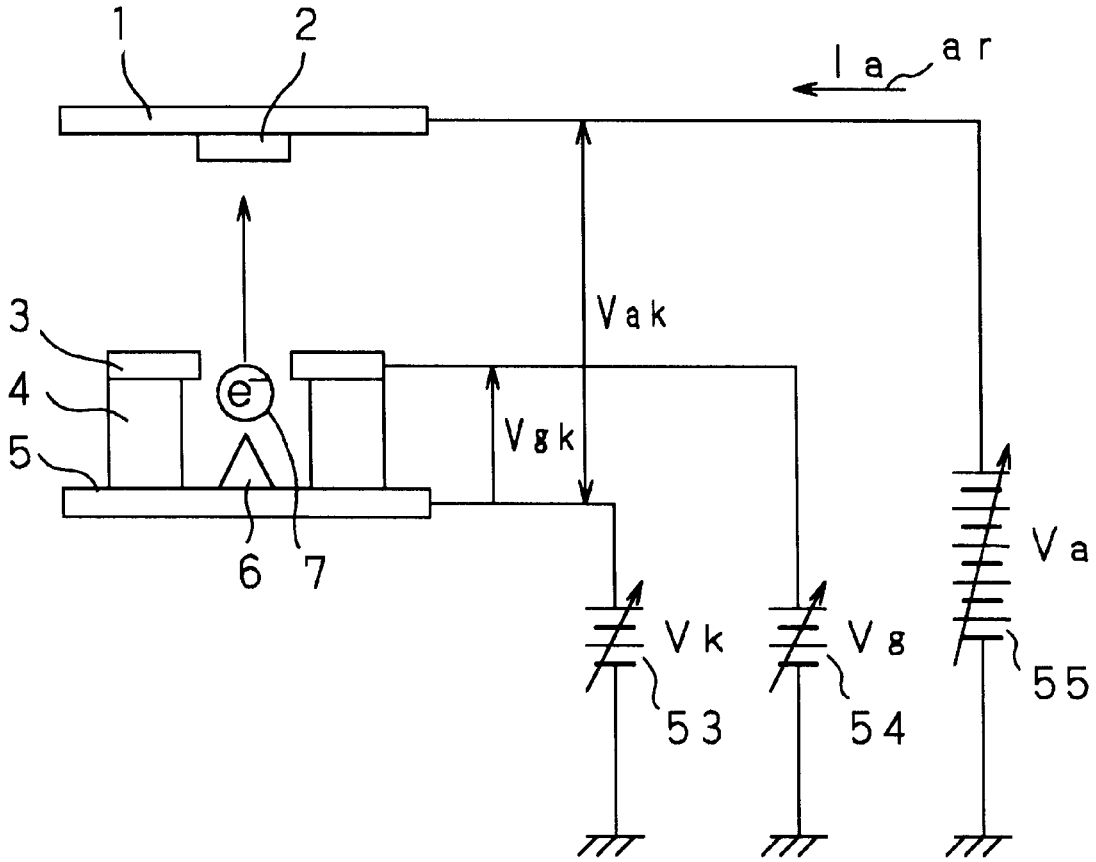
FIG. 2 illustrates the principle of a field emission cathode.

Meanwhile, the driver 23 driving the field emission cathode by the voltage as explained in connection with FIG. 2 of the prior-art system may be employed for the sample-and-hold circuit 20 and the shift register 21, while a conventional shift register may be employed for the shift register 25.

In FIG. 4, the number of output voltages Vout of the driver 23 is at least not less than the number of the cathode electrodes 27. In addition, the number of the inputs and outputs of the voltage-to-current conversion circuit 22 are also not less than the number of the cathode electrodes 27. In an actual configuration, there are provided a number of transistors 49 (current sources 63 of FIG. 6) not smaller than the number of the cathode electrodes 27. In such case, the inputs and the outputs of the voltage-to-current conversion circuit 22 are connected to the base terminals 46 and to the collector terminals 45 of the transistors 49, respectively.

What is claimed is:

1. A display apparatus comprising:

an anode electrode;

a first constant voltage source for applying a first constant voltage on said anode electrode;

a phosphor element coated on said anode electrode;

a gate electrode facing said phosphor element;

a second constant voltage source for applying a second voltage lower than said first voltage to said gate electrode;

a cathode electrode facing said phosphor element via said gate electrode; an insulator facing said phosphor element via said gate electrode;

a current source operatively electrically connected to said cathode electrode to control the voltage thereof thereby to control current flowing therethrough, said current source having its current value controlled in proportion to a third voltage corresponding to a signal to be displayed applied thereto; and a cathode arranged on said cathode electrode facing said phosphor element;

wherein, said current source is a transistor having a base terminal to which said third voltage corresponding to a signal to be displayed is applied, a collector terminal connected to said cathode electrode and an emitter electrode connected to a reference voltage through a resistor, and current through said resistor conforms to the equation: Vb=R *le−Vbe; where Vb=the third voltage corresponding to the signal to be displayed, le=current through the resistor; R=pre-set resistance of the resistor; Vbe=the potential difference between the base terminal and the emitter terminal.

2. A method of driving a field effect display comprising the steps of:

providing a display device comprised of an anode having a phosphor coating a cathode and a gate between the anode and the cathode;

applying a substantially constant voltage to the anode;

applying a substantially constant voltage to the gate; and controlling current through the cathode by controlling the voltage thereof by applying a current thereto from a current source, the current source comprising a transistor having a base coupled to a voltage corresponding to a signal to be displayed, an emitter coupled to a reference voltage via a resistor and a collector coupled to the cathode, current through the resistor conforming to relationship Vb=R*le−Vbe, where Vb is the voltage corresponding to the signal to be displayed, R is the resistance of the resistor, le is the current through the resistor and Vbe is a potential across the base and the emitter.

3. The method of driving a field effect transistor of claim 2, wherein the resistor has a resistance that is less than one thousand ohms.

* * * * *